US011201392B2

(12) United States Patent
Yamase et al.

(10) Patent No.: US 11,201,392 B2
(45) Date of Patent: Dec. 14, 2021

(54) ANTENNA APPARATUS

(71) Applicant: YOKOWO CO., LTD., Tokyo (JP)

(72) Inventors: Tomohiko Yamase, Tomioka (JP); Satoshi Iwasaki, Tomioka (JP); Kazuya Matsunaga, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 193 days.

(21) Appl. No.: 15/949,343

(22) Filed: Apr. 10, 2018

(65) Prior Publication Data

US 2018/0301796 A1 Oct. 18, 2018

(30) Foreign Application Priority Data

Apr. 17, 2017 (JP) ..... JP2017-081478
Jan. 31, 2018 (JP) ..... JP2018-015819

(51) Int. Cl.

| | |
|---|---|
| ***H01Q 1/32*** | (2006.01) |
| ***H01Q 1/36*** | (2006.01) |
| ***H01Q 9/16*** | (2006.01) |
| ***H01Q 13/08*** | (2006.01) |
| ***H01Q 9/38*** | (2006.01) |
| ***H01Q 21/30*** | (2006.01) |

(Continued)

(52) U.S. Cl.

CPC ..... *H01Q 1/36* (2013.01); *H01Q 1/32* (2013.01); *H01Q 1/3275* (2013.01); *H01Q 1/521* (2013.01); *H01Q 9/16* (2013.01); *H01Q 9/38* (2013.01); *H01Q 13/08* (2013.01); *H01Q 21/30* (2013.01); *H01Q 9/32* (2013.01)

(58) Field of Classification Search

CPC ..... H01Q 1/36; H01Q 1/32; H01Q 1/3275; H01Q 1/521; H01Q 13/08; H01Q 9/38; H01Q 9/16; H01Q 9/32; H01Q 21/30

See application file for complete search history.

(56) References Cited

U.S. PATENT DOCUMENTS 6,259,411 B1 * 7/2001 Yanagisawa ..... H01Q 1/085 343/712
2002/0158807 A1 * 10/2002 Kuramoto ..... H01Q 15/142 343/791

(Continued)

FOREIGN PATENT DOCUMENTS

JP H09-284024 A 10/1997
JP 2004-200832 A 7/2004

(Continued)

OTHER PUBLICATIONS

Office Action dated Sep. 21, 2021, issued in corresponding Japanese Patent Application No. 2018-015819.

*Primary Examiner* — Awat M Salih
(74) *Attorney, Agent, or Firm* — Morgan, Lewis & Bockius LLP

(57) ABSTRACT

An antenna apparatus has a sleeve antenna. The sleeve antenna has an internal conductive member, an external conductive member, an insulating member, and a mountain-shaped conductive member that is electrically connected to the external conductive member. The mountain-shaped conductive member expands radially from an upper edge towards a lower edge. The internal conductive member protrudes higher than the external conductive member above the upper edge of the mountain-shaped conductive member.

12 Claims, 16 Drawing Sheets

(51) Int. Cl.
*H01Q 1/52* (2006.01)
*H01Q 9/32* (2006.01)

(56) References Cited

U.S. PATENT DOCUMENTS

2005/0134511 A1* 6/2005 Haunberger ..... H01Q 1/40
343/725
2011/0291913 A1* 12/2011 Lai ..... H01Q 1/1214
343/878
2018/0138599 A1* 5/2018 Shehan ..... H01Q 9/32

FOREIGN PATENT DOCUMENTS

JP 2012-124714 A 6/2012
JP 2015-139211 A 7/2015

* cited by examiner

FIG. 10

| MODEL | MODEL 1 | MODEL 2 | MODEL 3 |
|---|---|---|---|
| | 0° | 10° | 30° |
| DIRECTIONAL CHARACTERISTIC | 0 5 0 -5 -10 -15 -20 90 180 270 | 0 5 0 -5 -10 -15 -20 90 180 270 | 0 5 0 -5 -10 -15 -20 90 180 270 |
| AVERAGE GAIN [dBi] | 2.2 | 2.4 | 2.4 |
| ANGLE α [°] | 0° | 10° | 30° |

FIG. 11
| MODEL | MODEL 4 | MODEL 5 | MODEL 6 |
|---|---|---|---|
| | 60° | 80° | 90° |
| DIRECTIONAL CHARACTERISTIC | 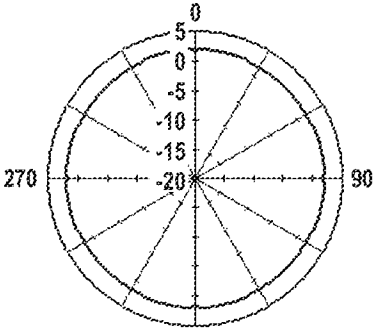 | 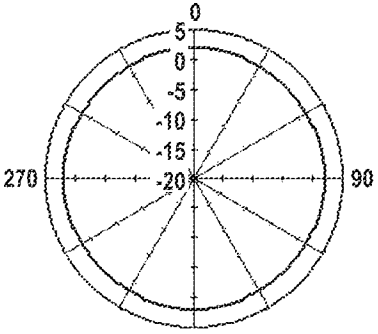 | 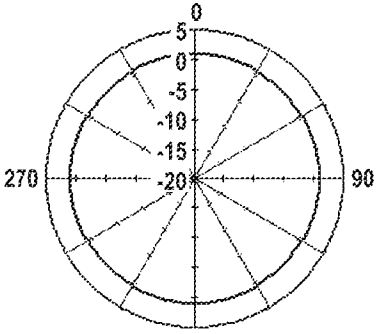 |
| AVERAGE GAIN [dBi] | 1.8 | 1.8 | 0.9 |
| ANGLE α [°] | 60° | 80° | 90° |

FIG. 12

| MODEL | HORIZONTAL PLANE DIRECTIONAL CHARACTERISTIC |
|---|---|
| MODEL 11; SIDE VIEW 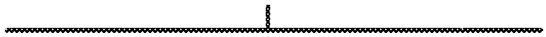 | 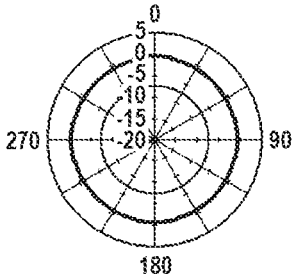  |
| AVERAGE GAIN: | -0.8 |
| MONOPOLE ANTENNA ALONE | |
| MODEL 12; SIDE VIEW 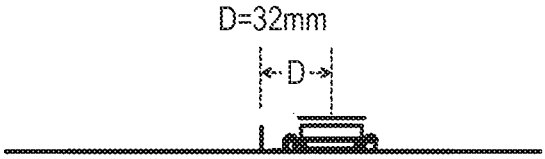  | 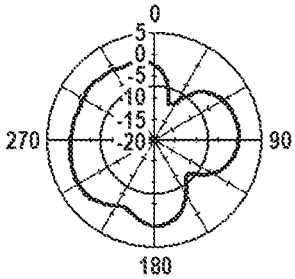  |
| AVERAGE GAIN: | -1.7 |
| MONOPOLE ANTENNA + SXM (DISTANCE 32 mm) (※32 mm = $\lambda_2/4$ IN SXM BAND) | |
| MODEL 13; SIDE VIEW 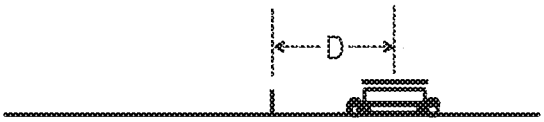  | 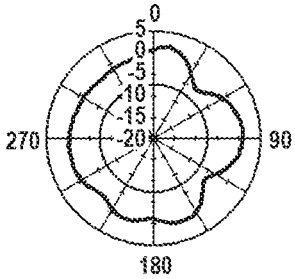  |
| AVERAGE GAIN: | -0.8 |
| MONOPOLE ANTENNA + SXM (DISTANCE 32 mm + $\lambda_1/2$) (※$\lambda_1/2$ = 25.4 mm IN V2X BAND) | |
| MODEL 14; SIDE VIEW 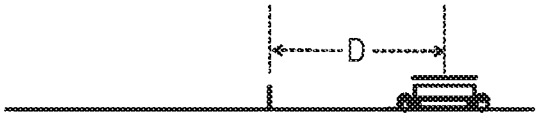  | 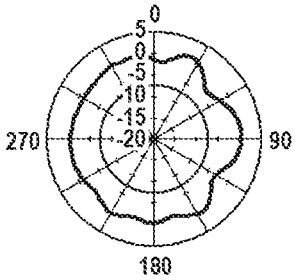  |
| AVERAGE GAIN: | -0.8 |
| MONOPOLE ANTENNA + SXM (DISTANCE 32 mm + $\lambda_1$) (※$\lambda_1$ = 50.8 mm IN V2X BAND) | |

FIG. 13
| MODEL | HORIZONTAL PLANE DIRECTIONAL CHARACTERISTIC |
|---|---|
| MODEL 21; SIDE VIEW 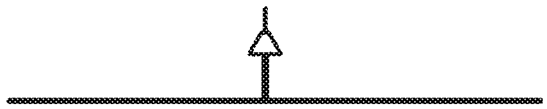 | 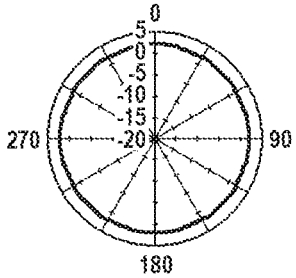  |
| AVERAGE GAIN: | 1.9 |
| SLEEVE ANTENNA ALONE | |
| MODEL 22; SIDE VIEW 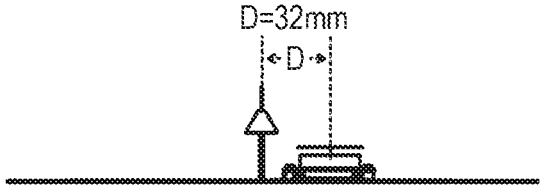  | 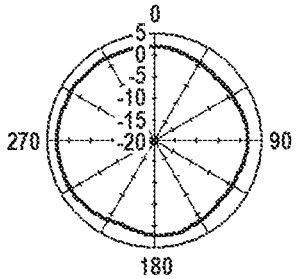  |
| AVERAGE GAIN: | 1.8 |
| SLEEVE ANTENNA + SXM (DISTANCE 32 mm)(※32 mm = λ2/4 IN SXM BAND) | |
| MODEL 23; SIDE VIEW 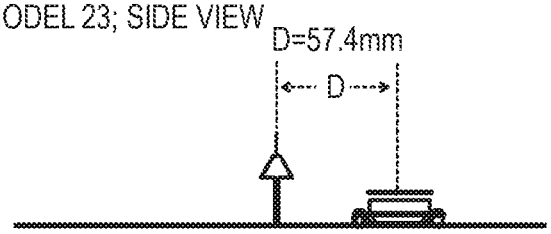  | 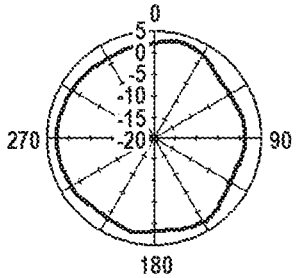  |
| AVERAGE GAIN: | 1.9 |
| SLEEVE ANTENNA + SXM (DISTANCE 32 mm + λ1/2) (※λ1/2 = 25.4 mm IN V2X BAND) | |
| MODEL 24; SIDE VIEW 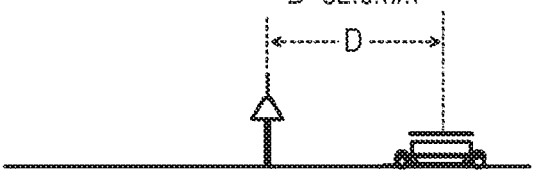  | 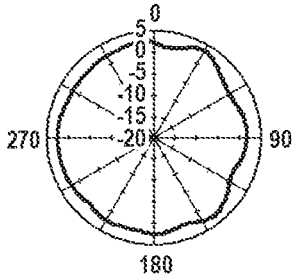  |
| AVERAGE GAIN: | 2.0 |
| SLEEVE ANTENNA + SXM (DISTANCE 32 mm + λ1)(※λ1 = 50.8 mm IN V2X BAND) | |

ANTENNA APPARATUS

CROSS-REFERENCES TO RELATED APPLICATIONS

This patent application is based on and claims priority from Japanese Patent Applications No. 2017-081478 filed on Apr. 17, 2017 and No. 2018-015819 filed on Jan. 31, 2018, the entire contents of which are incorporated herein by reference.

BACKGROUND

1. Field of the Invention

This disclosure relates to an antenna apparatus suitable for a vehicle onboard application and more particularly to an antenna apparatus including an antenna applied to an information communication system, such as a sleeve antenna or the like.

2. Description of Related Art

Recently, vehicle antennas called a shark-fin type antenna have been under development. In the vehicle antennas, in addition to broadcasting reception antennas such as AM/FM antennas, there is a tendency of mounting antennas applied to the information communication system (for example, vehicle-to-vehicle communication antennas, road-to-vehicle communication antennas) such as a sleeve antenna. In the information communication antennas such as the sleeve antenna, linearly polarized waves, in particular, vertically polarized waves are received and transmitted, and its horizontal plane directional characteristic is required to be omnidirectional. In addition, a predetermined gain is needed to be ensured.

In the case where the information communication antenna and other antennas excepting the information communication antenna, for example, a satellite planar antenna are provided close to each other in a limited space within a case of an antenna apparatus, a sufficient distance cannot be ensured between the antennas, and the gains of the antennas are reduced. On the other hand, when attempting to ensure a great or sufficient distance between the antennas within the case, the case is increased in size, and the antenna apparatus cannot be made smaller in size.

JP-A-2015-139211 discloses a structure in which a plurality of types of antennas are accommodated in a single case.

SUMMARY

One or more embodiments relate to an antenna apparatus preferable for an application to information communication antennas such as a sleeve antenna.

One or more embodiments relate to an antenna apparatus in which deterioration of characteristics is small even when different types of antennas are provided close to each other and which is suitable for miniaturization.

According to one or more embodiments, an antenna apparatus has a sleeve antenna. The sleeve antenna has an internal conductive member, an external conductive member, an insulating member, and a mountain-shaped conductive member that is electrically connected to the external conductive member. The mountain-shaped conductive member expands radially from an upper edge towards a lower edge. The internal conductive member protrudes upward from the upper edge of the mountain-shaped conductive member. In other words, the internal conductive member protrudes outwards of the external conductive member above the upper edge of the mountain-shaped conductive member.

According to one or more embodiments, an antenna apparatus includes an antenna suitable for an application to an information communication antenna such as a sleeve antenna and has a characteristic suitable for execution of, for example, an onboard vehicle-to-vehicle communication or road-to-vehicle communication.

Other aspects and advantages of the invention will be apparent from the following description and the appended claims.

BRIEF DESCRIPTION OF THE DRAWINGS

FIG. 10 is an explanatory drawing showing directional characteristics and average gains corresponding to sleeve antennas of models 1 to 3 that differ from one another in an angle $\alpha$ that is formed by a line connecting an upper edge and a lower edge of a mountain-shaped conductive member and an axial direction of an external conductive member.

FIG. 11 is an explanatory drawing showing directional characteristics and average gains corresponding to sleeve antennas of models 4 to 6 that differ from one another in an angle $\alpha$ that is formed by a line connecting an upper edge and a lower edge of a mountain-shaped conductive member and an axial direction of an external conductive member.

FIG. 12 is an explanatory drawing showing directional characteristics and average gains of models 11 to 14 in which a monopole antenna is disposed alone and a planar antenna is disposed near to the monopole antenna with different distances.

FIG. 13 is an explanatory drawing showing directional characteristics and average gains of models 21 to 24 in which the sleeve antenna of the first exemplary embodiment is disposed alone and a planar antenna is disposed near to the sleeve antenna with different distances.

DETAILED DESCRIPTION

Figure 1:
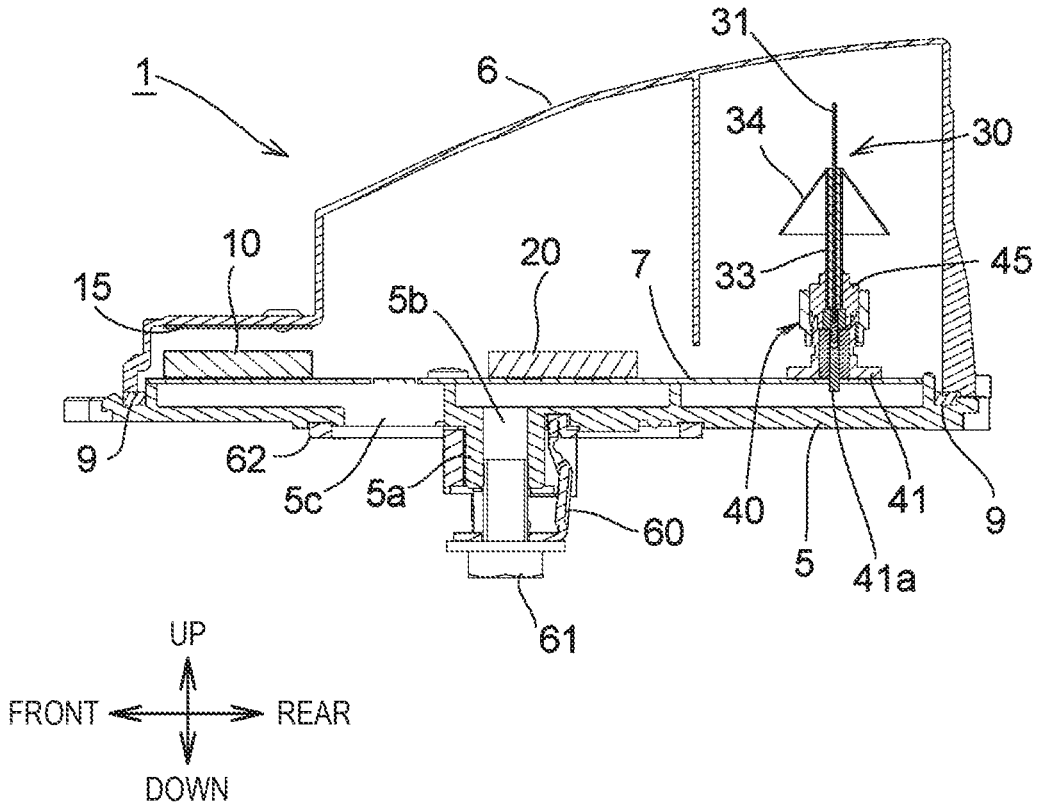
FIG. 1 is a side sectional view showing a front-and-rear or longitudinal section of an antenna apparatus of a first exemplary embodiment.
Figure 2:
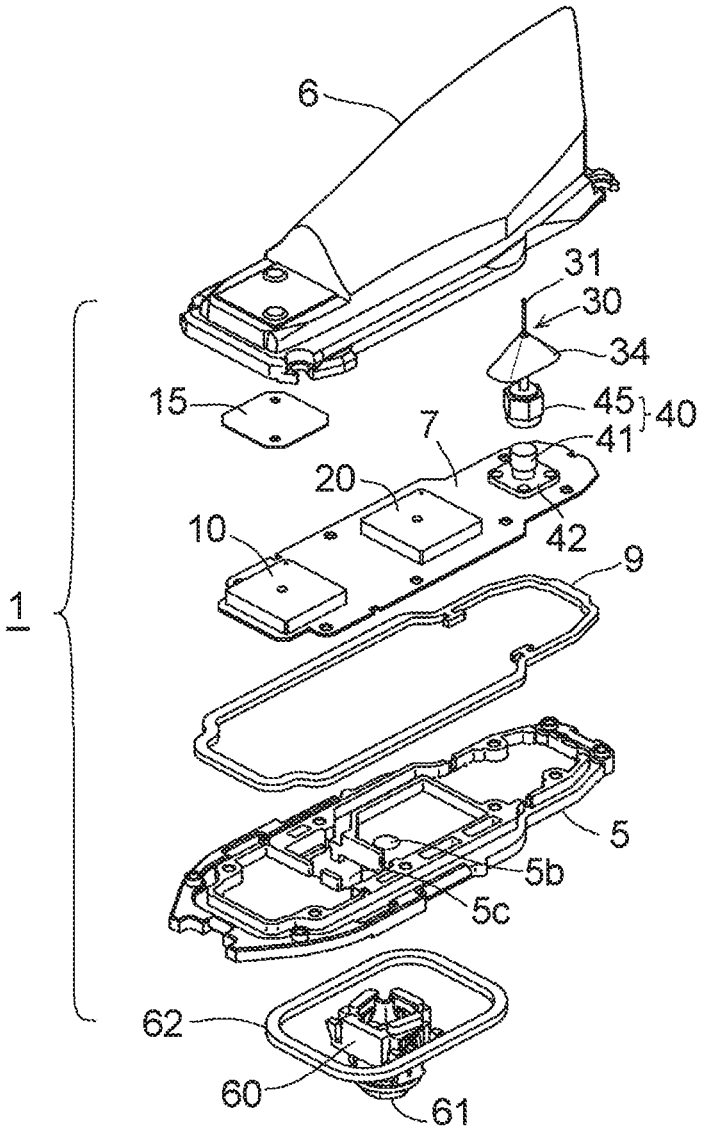
FIG. 2 is an exploded perspective view of the antenna apparatus of the first exemplary embodiment.
Figure 3:
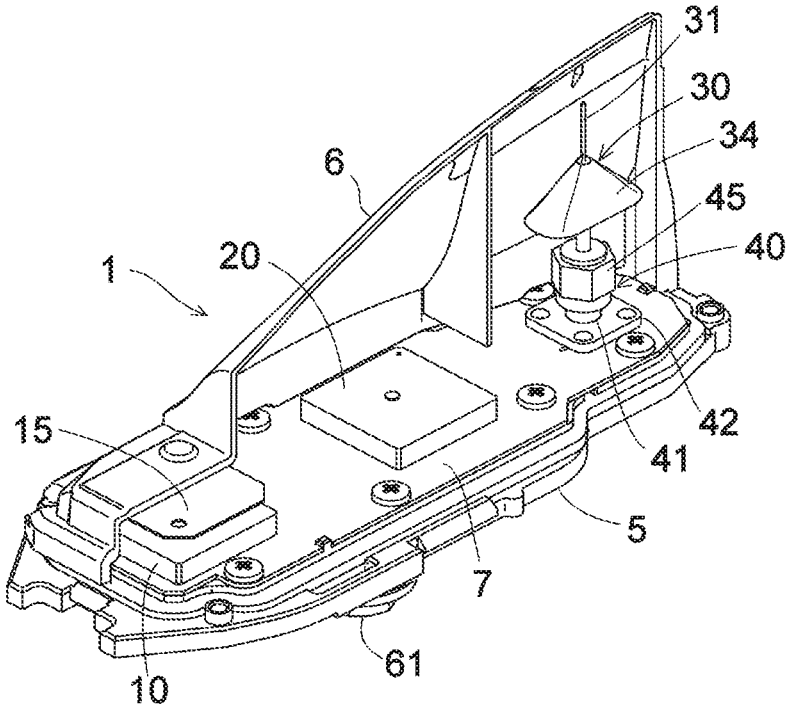
FIG. 3 is a perspective view of the antenna apparatus of the first exemplary embodiment with an inner case sectioned half longitudinally.
Figure 4:
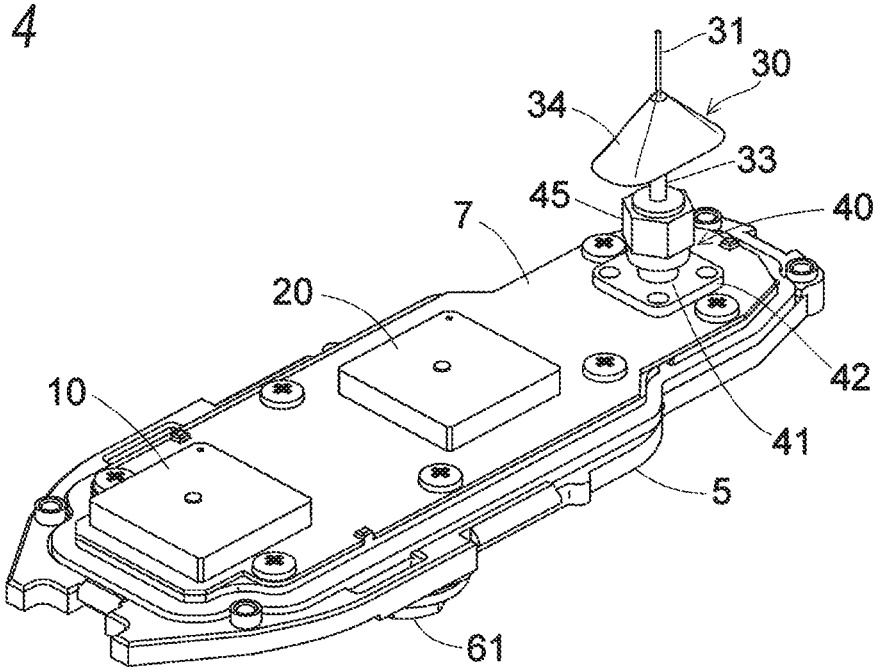
FIG. 4 is a perspective view of the antenna apparatus shown in FIG. 3 in which the inner case is omitted.

Embodiments will be described in detail, referring to drawings. Common reference numerals will be given to the same or similar constituent elements, members, processes and the like shown in the drawings, so that the repetition of similar descriptions is omitted as appropriate. Additionally, exemplary embodiments are not intended to limit the invention but to exemplify the invention, and hence, all features that are described in the exemplary embodiments and combinations thereof are not always essential to the invention.

Referring to FIGS. 1 to 6, an antenna apparatus according to a first exemplary embodiment will be described. Here, a front-and-rear or longitudinal direction and an up-and-down or vertical direction of an antenna apparatus 1 are shown in FIG. 1. In a sheet of paper illustrating FIG. 1, a left-hand side denotes a front side of the antenna apparatus 1, a right-hand side denotes a rear side of the antenna apparatus 1, an upper side denotes an upper side of the antenna apparatus 1, and a lower side denotes a lower side of the antenna apparatus 1. In FIGS. 1 to 6, the antenna apparatus 1 has a metallic base 5, an insulating board 7 that is fixed on to the base 5 with screws, and a radio wave permeable inner case 6 that is screwed to the base 5 in such a way as to cover an upper side of the base 5 with the board 7 encapsulated therein. In addition, in the antenna apparatus 1, an SXM (satellite radio) planar antenna (patch antenna) 10, a GPS planar antenna (patch antenna) 20 and a V2X sleeve antenna 30 are disposed sequentially in that order from the front in an interior space surrounded by the base 5 and the inner case 6, that is, on an upper side of the board 7. An operation frequency of the sleeve antenna 30 is an DSRC band but may be a telephone band. A parasitic element 15 made of a metallic plate is disposed and fixed to a ceiling surface of a front portion of the inner case 6 so as to face an upper side of the SXM planar antenna 10. Directivities of the SXM planar antenna 10 and the GPS planar antenna 20 that are mounted on the board 7 are directed vertically upward of the board 7, that is, in a zenithal direction (an upward direction of a normal line to the ground). A waterproof structure is provided between the base 5 and the inner case 6 via a waterproof packing 9. For example, a shark fin-shaped outer case is fixed to the base so as to cover the inner case 6, but the outer case is omitted from drawings.

A protruding portion 5*a* is provided on the base 5 in such a way as to protrude downwards from a bottom face thereof, and a threaded hole 5*b* is formed in the protruding portion 5*a* so as to be opened to a lower end face of the protruding portion 5*a*. The protruding portion 5*a* penetrates a mounting hole in a mating mount member such a roof of a vehicle body. The base 5 is fixed to the mating mount member by mounting a capture fastener (a mounting part) 60 on an opposite side to a base 5 mounting surface of the mating mount member with a bolt 61 that screws into the threaded hole 5*b* and tightening it. A waterproof seal 62 is interposed between the base 5 and the mating mount member to ensure waterproofness therebetween. A cable outlet hole 5*c* is formed in the base 5, but cables connecting to the individual antennas 10, 20, 30 are omitted from the drawings.

Figure 5:
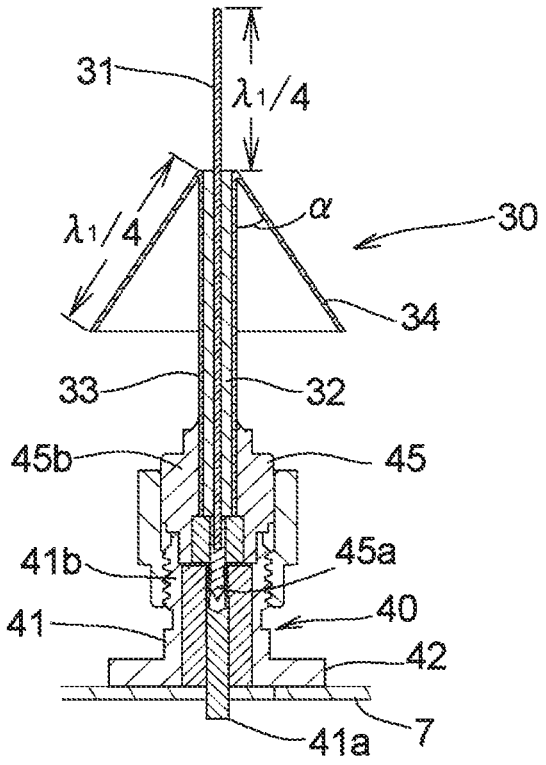
FIG. 5 is a vertical sectional view of a V2X sleeve antenna of the first exemplary embodiment.

As shown in FIG. 5, a receptacle 41 of a coaxial connector 40 (made up of a combination of the receptacle 41 as one coupling member and a plug 45 as the other coupling member) is fixed on to the upper side of the insulating board 7 in such a way as to be directed upwards. The V2X sleeve antenna 30 is built up integrally with the plug 45 that fits into the receptacle 41. The sleeve antenna 30 has the plug 45 having a coaxial structure, a linear internal conductive member 31 that connects to a central conductive member 45*a* of the plug 45, an insulating member 32 that covers an outer circumference of the internal conductive member 31, a straight cylindrical external conductive member 33 that covers further the outer circumference of the insulating member 32 and that connects to an outer circumferential conductive member 45*b* of the plug 45, and a mountain-shaped conductive member 34 that connects to the external conductive member 33 at an upper edge of the mountain-shaped conductive member 34. Hereinafter, when referred to, a mountain shape means a shape that radially expands from an upper edge towards a lower edge and whose height lowers as it extends from the upper edge towards the lower edge, that is, a shape of a hollow cone such as a circular cone or a pyramid but without a bottom face. A lower distal end of the central conductive member 45*a* of the plug 45 extends further downwards than radial elements of the planar antennas 10, 20. A lower distal end of a central conductive member 41*a* of the receptacle 41 that connects to the central conductive member 45*a* of the plug 45 extends further downwards than the radial elements of the planar antennas 10, 20 to penetrate the board 7. The insulating member 32 and the external conductive member 33 do not exist above an upper edge of the mountain-shaped conductive member 34, and hence, only the internal conductive member 31 protrudes upward from the upper edge of the mountain-shaped conductive member 34, that is, the internal conductive member 31 is exposed to an exterior portion. The internal conductive member 31, the insulating member 32 and the external conductive member 33 make up a coaxial structure with the internal conductive member 31 functioning as a central conductive member. An angle $\alpha$ that is formed by a line connecting the upper edge and the lower edge of the mountain-shaped conductive member 34 and an axial direction (a vertical direction) of the external conductive member 33 is smaller than 90°, that is, an acute angle. The angle α is preferably in a range from about 10° to about 30°. Assuming that a wavelength of an operation frequency of the sleeve antenna 30 is $\lambda_1$, a length from the upper edge to the lower edge of the mountain-shaped conductive member 34 is $\lambda_1/4$, and a vertical length of the internal conductive member 31 above the upper edge of the mountain-shaped conductive member 34 is also $\lambda_1/4$.

The receptacle 41 has a square flange portion 42 that is integral therewith and is screwed to be fixed to the board 7 at the square flange portion 42. With the plug 45 fitted on and coupled to the receptacle 41, the central conductive member 45*a* of the plug 45 connects to the central conductive member 41*a* of the receptacle 41, and the outer circumferential conductive member 45*b* of the plug 45 connects to an outer circumferential conductive member 41*b* of the receptacle 41. In a configuration shown in FIG. 5, the outer circumferential conductive member 45*b* is screwed onto the outer circumferential conductive member 41*b* that is externally threaded. However, a configuration may be adopted in which the outer circumferential conductive member 45*b* is fitted on an external side of a circumferential conductive member 41*b* where no thread is formed.

Figure 6:
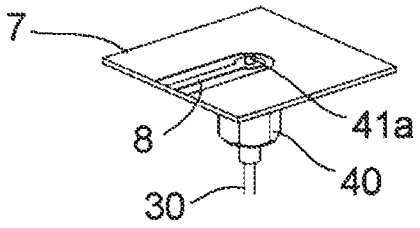
FIG. 6 is a partially perspective view showing the vicinity of a coaxial connector for installation of the V2X sleeve antenna of the first exemplary embodiment as seen from below a board.

As shown in FIG. 6, the central conductive member 41*a* of the receptacle 41 that penetrates the board 7 to reach a lower surface thereof is connected to a microstrip line 8 on the lower surface of the board 7 by soldering. Further, the central conductive member 41*a* of the receptacle 41 passes through the cable outlet hole 5*c* in the base 5 to be pulled out to an exterior portion via a coaxial cable (not shown) whose central conductive member connects to the microstrip line 8 in a vicinity of the cable outlet hole 5*c* in the base 5 shown in FIG. 1. The outer circumferential conductive member 41*b* connects to a ground conductive member of the board 7 and further connects to an external conductive member of the coaxial cable.

<Coaxial Connector>

The antenna apparatus 1 is structured so that the sleeve antenna 30 is mounted on the board 7 using the coaxial connector 40. The sleeve antenna 30 can be erected vertically with respect to the board 7 in an ensured manner only by fitting the plug 45 that is fixed integrally to a lower portion of the sleeve antenna 30 in the receptacle 41. Consequently, this method of erecting the sleeve antenna 30 with respect to the board 7 is easier than a method of erecting the sleeve antenna perpendicularly with respect to the board by soldering the sleeve antenna to the board (in the case of the method using soldering, there is a risk of the sleeve antenna being not erected perfectly perpendicularly with respect to the board to thereby be inclined). In addition, since the internal conductive member 31 is covered with the external conductive member 33 and the outer circumferential conductive member 41*b* of the receptacle 41, the internal conductive member 31 is affected less when the outer circumferential conductive member 45*b* of the plug 45 is screwed on to the outer circumferential conductive member 41*b* of the receptacle 41.

Figure 7:
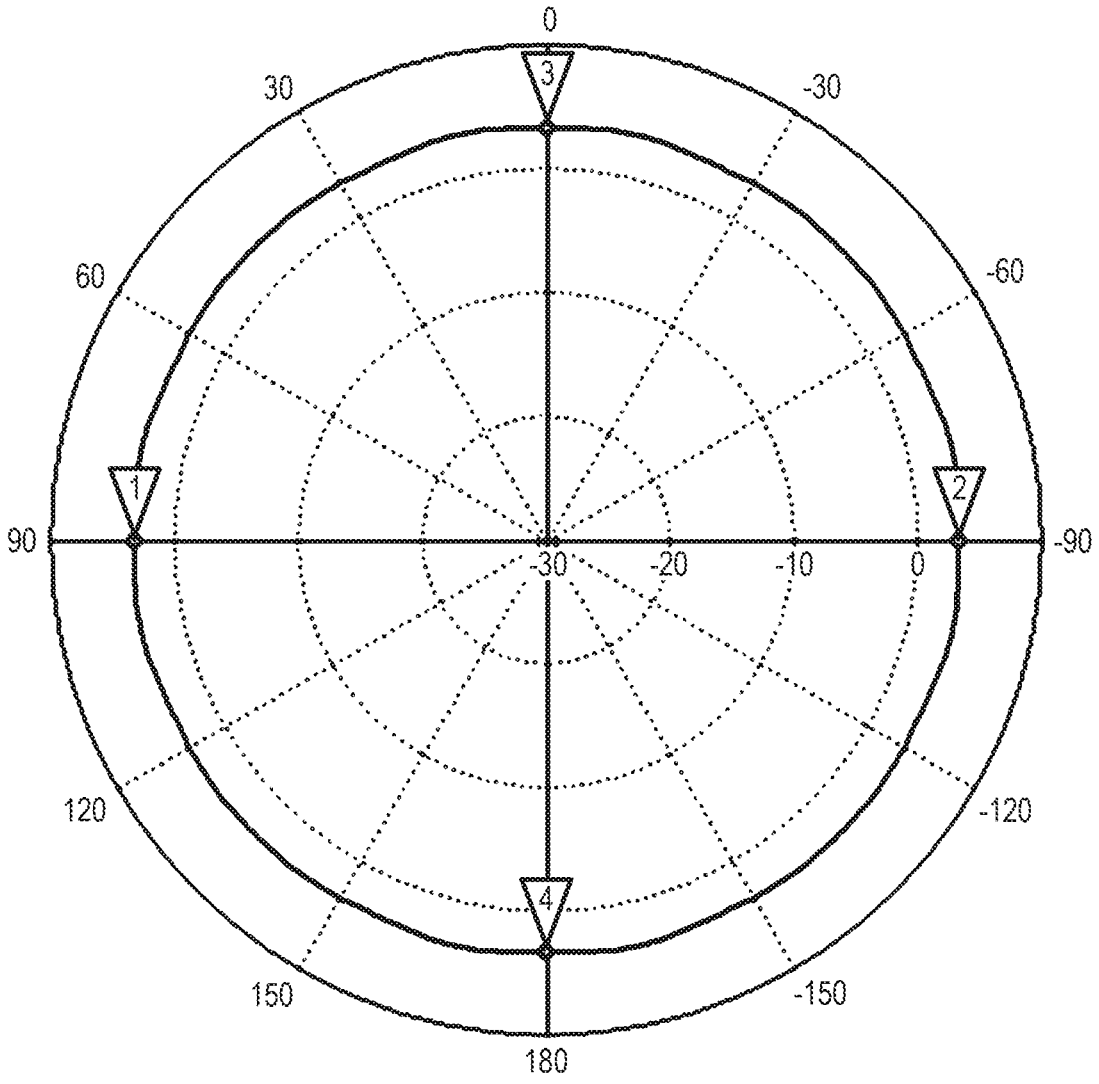
FIG. 7 is a simulated directional characteristic diagram showing a horizontal plane directivity of the V2X sleeve antenna of the first exemplary embodiment that erects with respect to a horizontal plane.
Figure 8:
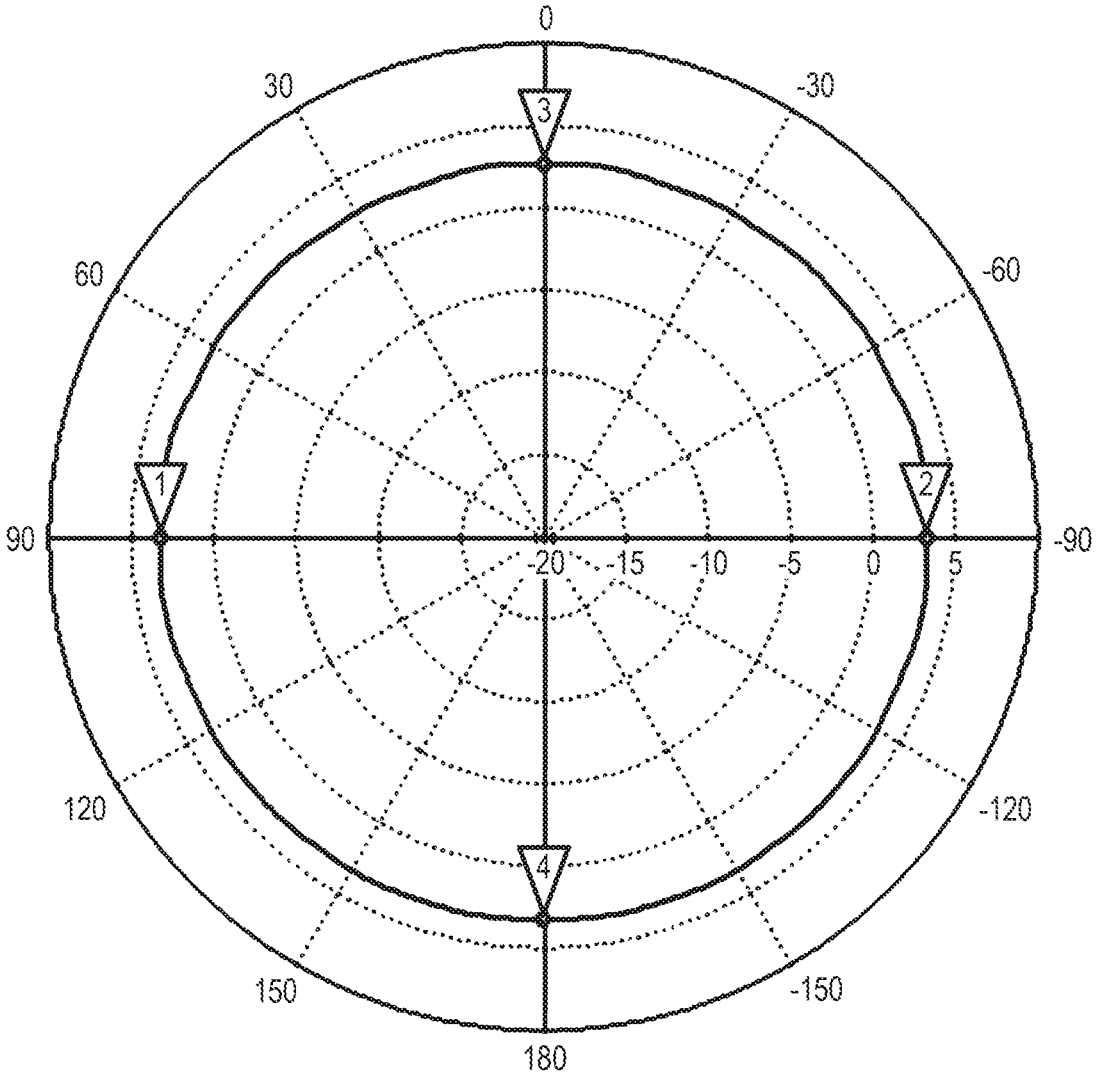
FIG. 8 is a simulated directional characteristic diagram showing a horizontal plane directivity of the V2X sleeve antenna of the first exemplary embodiment when the V2X sleeve antenna is inclined 5° with respect to a normal of the horizontal plane.
Figure 9:
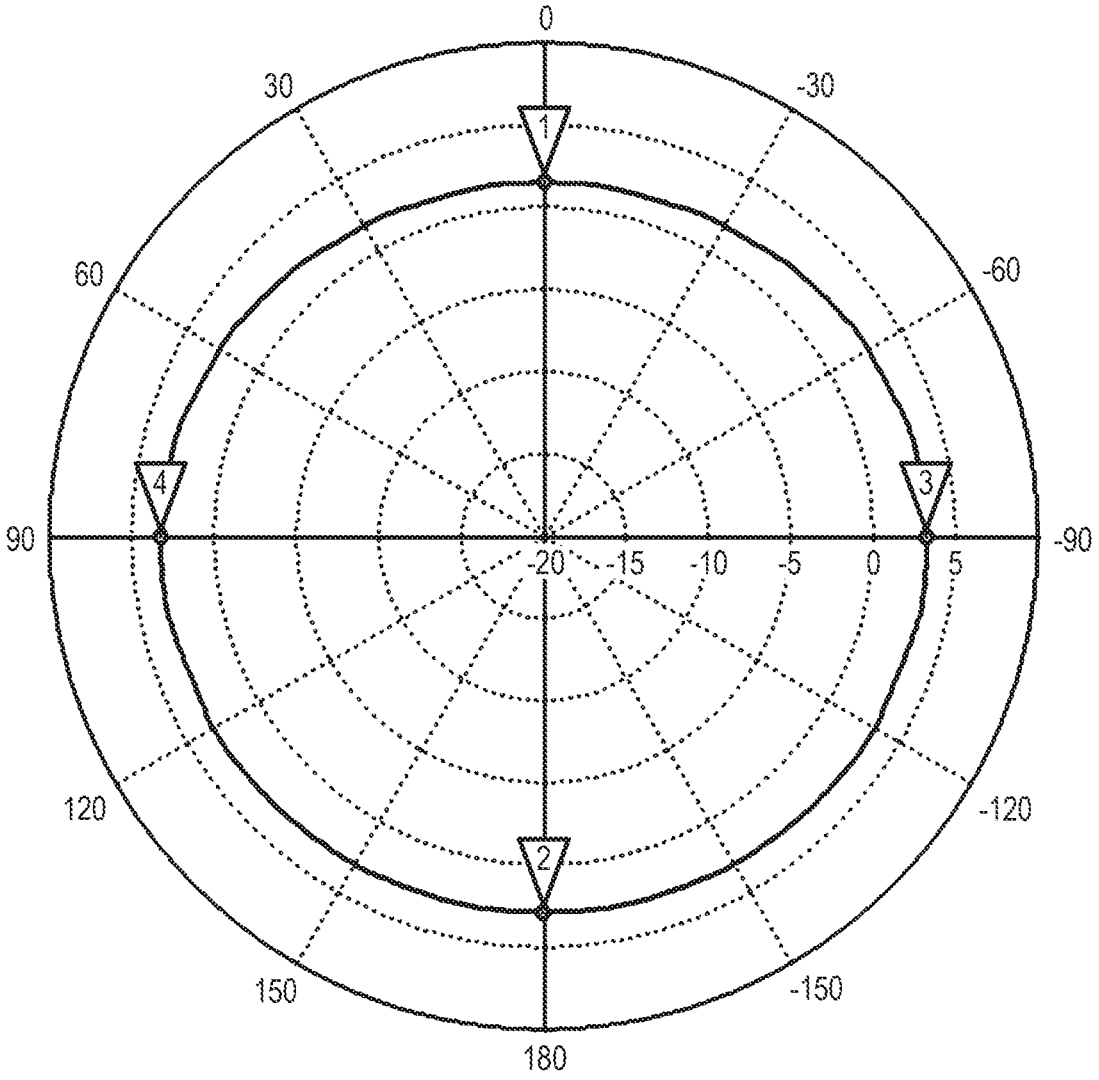
FIG. 9 is a simulated directional characteristic diagram showing a horizontal plane directivity of the V2X sleeve antenna of the first exemplary embodiment when the V2X sleeve antenna is inclined 10° with respect to the normal of the horizontal plane.

FIG. 7 is a simulated characteristic diagram showing a horizontal plane directivity of the sleeve antenna 30 in a linearly polarized wave and a vertically polarized wave when the sleeve antenna 30 erects perpendicular with respect to the horizontal plane. FIG. 8 is a simulated characteristic diagram showing a horizontal plane directivity of the sleeve antenna 30 in a vertically polarized wave when the sleeve antenna 30 is inclined 5° from a normal to a horizontal plane. FIG. 9 is a simulated characteristic diagram showing a horizontal plane directivity of the sleeve antenna 30 when the sleeve antenna 30 is inclined 10° from a normal to a horizontal plane. In FIGS. 7 to 9, the simulations are carried out using only the sleeve antenna 30 and the metallic base 5, and a direction extending from a center at an angle of 0° denotes a front direction of the antenna apparatus 1. A gain deviation, which indicates the directivity of the sleeve antenna 30, resulting from deducting a minimum gain from a maximum gain in each of the characteristic diagrams is 0 dBi in FIG. 7, 0.6 dBi in FIG. 8 and 1.7 dBi in FIG. 9.

As FIGS. 7 to 9 show, when the angle at which the sleeve antenna 30 is inclined from the normal to the horizontal plane is small, the gain deviation becomes small and the horizontal plane directivity of the sleeve antenna 30 is improved (approaching an ideal omnidirectional characteristic). Since the sleeve antenna 30 is erected in the perpendicular direction with respect to the board 7 by making use of the coaxial connector 40 as a mounting part, there is no risk of the sleeve antenna 30 being inclined at the time of fabrication, thereby making it possible to maintain the horizontal plane directivity of the sleeve antenna 30 in a good condition.

<Angle α Formed by a Line Connecting an Upper Edge and a Lower Edge of the Mountain-Shaped Conductive Member 34 and an Axial Direction of the External Conductive Member>

FIG. 10 is an explanatory drawing showing simulated horizontal plane directivities and average gains [dBi] in a vertically polarized wave of three models of Model 1 in which the angle α is 0° where the mountain-shaped conductive member 34 is completely closed, Model 2 in which the angle α is 10° and Model 3 in which the angle α is 30°. FIG. 11 is an explanatory drawing showing simulated horizontal plane directivities and average gains [dBi] in a vertically polarized wave of Model 4 in which the angle α is 60°, Model 5 in which the angle α is 80° and Model 6 in which the angle α is 90°. In FIGS. 10 and 11, a direction extending at an angle of 0° from the center denotes a front direction of the antenna apparatus 1. It is seen from the drawings that although all the models do not differ greatly in directional characteristic, in relation to the average gain, Model 2 (the angle α=10°) and Model 3 (the angle α=30°) is greater than Model 1 (the angle α=0°) and that the average gain becomes higher when the angle α is in a range from about 10° to about 30° than when the angle α is 0°.

<Characteristics of the Mountain-Shaped Conductive Member 34 when a Planar Antenna Lies Close Thereto>

FIG. 12 shows simulated horizontal plane directional characteristics in a vertically polarized wave of a monopole antenna in Models 11 to 14. Model 11 represents a case where a monopole antenna is provided alone. Models 12 to 14 represent cases where a planar antenna (a patch antenna) is disposed close to a monopole antenna on the same base plate. In Models 12 to 14, a distance D between the monopole antenna and a center of the planar antenna on a plane parallel to the base plate is 32 mm, 57.4 mm and 82.8 mm, respectively. Here, assuming that a wavelength of an SXM band that is an operation frequency of the planar antenna is $\lambda_2$, 32 mm corresponds to $\lambda_2/4$. Assuming that a wavelength of a DSRC band that is an operation frequency of the monopole antenna is $\lambda_1$, 57.4 mm corresponds to 32 mm+$\lambda_1/2$. Additionally, 82.8 mm corresponds to 32 mm+$\lambda_1$.

As is seen from Models 12 to 14 in FIG. 12, with the planar antenna lies near the monopole antenna, the horizontal plane directional characteristic is deteriorated remarkably when compared with Model 11 in which the monopole antenna is provided alone.

FIG. 13 shows simulated horizontal plane directional characteristics in a vertically polarized wave of a sleeve antenna in Models 21 to 24. Model 21 represents a case where a sleeve antenna is provided alone. Models 22 to 24 represent cases where a planar antenna (a patch antenna) is disposed close to a sleeve antenna on the same base plate. In Models 22 to 24, a distance D between the sleeve antenna and a center of the planar antenna on a plane parallel to the base plate is 32 mm, 57.4 mm and 82.8 mm, respectively. In FIG. 13, an angle $\alpha$ of a mountain-shaped conductive member 34 of the sleeve antenna is 30°, and an operation frequency (an SXM band) of the planar antenna and an operation frequency (a DSRC band) of the sleeve antenna remain the same as those in the models shown in FIG. 12.

As is seen from Models 22 to 24 in FIG. 13, even though the planar antenna lies near the sleeve antenna, or, specifically, even though a center of the planar antenna lies within 82.8 mm ($=\lambda_1+\lambda_2/4$) from a center of the sleeve antenna, when compares with the case where the planar antenna lies near the monopole antenna, the horizontal plane directional characteristic of the sleeve antenna has a little deterioration. Further, the sleeve antennas in Models 22 to 24 are superior to the monopole antennas in Models 12 to 14 in relation to the directional characteristic.

Figure 14:
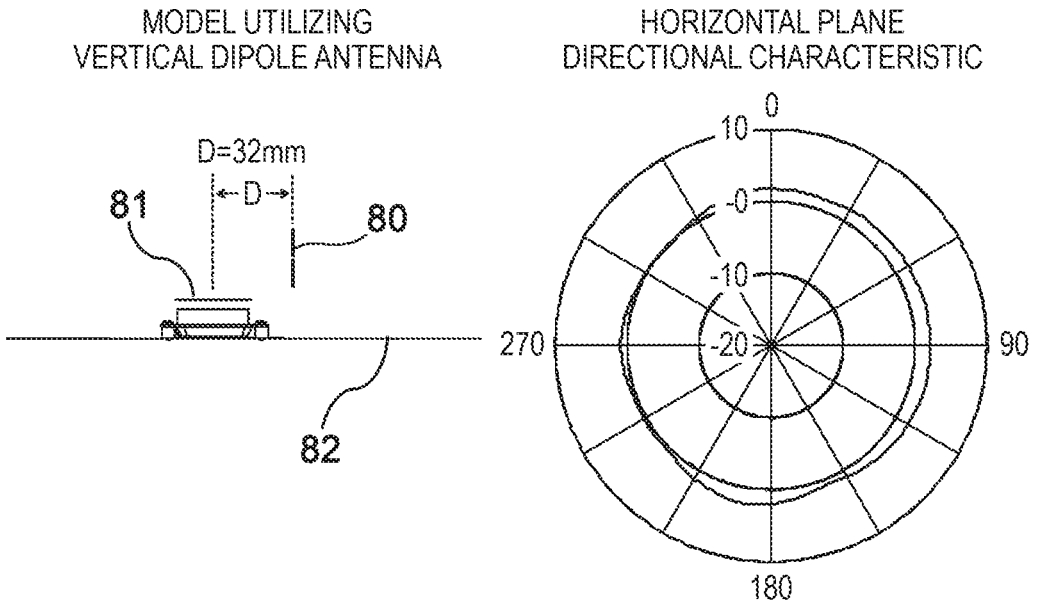
FIG. 14 is an explanatory drawing showing directional characteristics of a model in which a planar antenna is disposed close to a vertical dipole antenna.

FIG. 14 shows a simulated horizontal plane directional characteristic in a vertically polarized wave of a vertical dipole antenna 80 in a model in which a planar antenna 81 is disposed close to the vertical dipole antenna 80 on the same base plate 82 and a distance D between the vertical dipole antenna 80 and a center of the planar antenna 81 is 32 mm. In FIG. 14, an operation frequency (an SXM band) of the planar antenna 81 and an operation frequency (a DSRC band) of the vertical dipole antenna 80 remain the same as those of the planar antenna and the sleeve antenna in FIG. 12. Even though the planar antenna 81 lies near the vertical dipole antenna 80, the horizontal plane directional characteristic of the vertical dipole antenna 80 has a little deterioration. On the other hand, there is a tendency that a vertical height of the vertical dipole antenna 80 is greater than that of the sleeve antenna.

As is seen from FIGS. 12 to 14, the sleeve antenna 30 having the mountain-shaped conductive member 34 has a better directional characteristic than that of the monopole antenna even though a planar antenna is provided near thereto. Further, with the sleeve antenna 30, a horizontal plane directional characteristic would be obtained which is as good as that of a vertical dipole antenna, and a vertical height would be lowered with respect to a vertical height of the dipole antenna.

<Vertical Height of the Sleeve Antenna 30>

Figure 15:
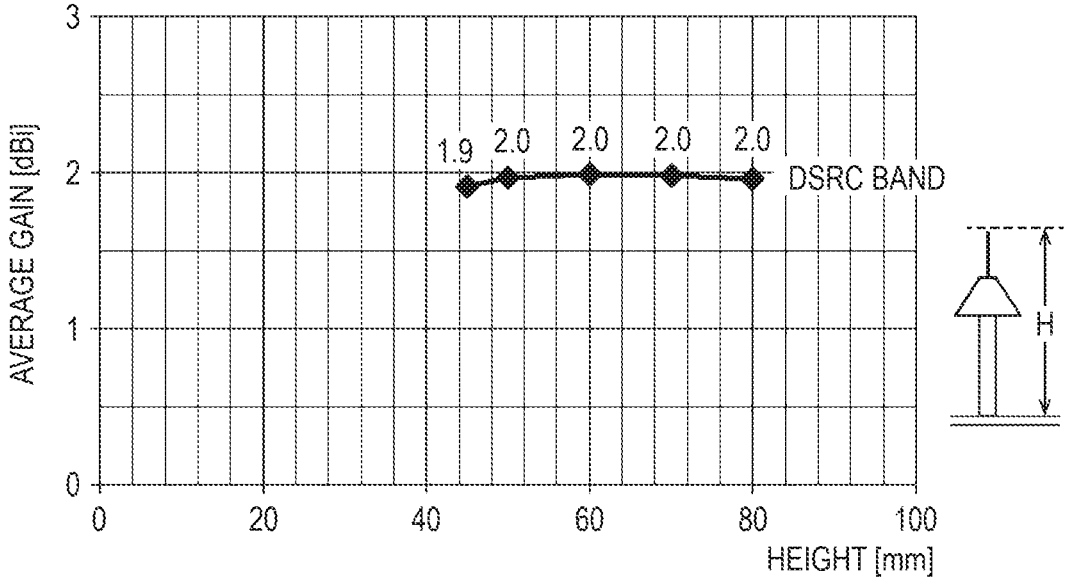
FIG. 15 is a graph showing a relationship between a vertical height of the sleeve antenna shown in the first exemplary embodiment from a base plate (corresponding to a metallic base) and a horizontal plane average gain.

FIG. 15 is an actually measured characteristic diagram showing a relationship between a vertical height H and a horizontal plane average gain of the sleeve antenna 30. In measurement, a coaxial connector 40 was provided on a flat plate (corresponding to the metallic base 5) that constitutes a square base plate with a side of 300 mm that is formed by covering both sides of a board of FR-4 with a conductive material. Then, sleeve antennas 30 whose vertical heights (a vertical height H is a distance between the flat plate to a top of the sleeve antenna) are 45 mm, 50 mm, 60 mm, 70 mm, 80 mm were fitted (mounted) in the coaxial connector 40, and actual measurements were carried out on the sleeves 30. 5887.5 MHz of the DSRC band was used for the reception frequency of the sleeve antennas 30.

In general, a horizontal plane average gain of an antenna element reduces as a vertical height of the antenna element lowers. As shown in FIG. 15, however, even though the vertical height of the sleeve antenna 30 is equal to or less than 70 mm, no great change is found in the horizontal plane average gains [dBi] in a vertically polarized wave of the sleeve antennas 30. Accordingly, with its vertical height being equal to or less than 70 mm, the sleeve antenna 30 would obtain a sufficient horizontal plane average gain irrespective of its vertical height.

According to this exemplary embodiment, the following features would be provided.

(1) The antenna apparatus 1 includes the sleeve antenna 30 that has the internal conductive member 31, the insulating member 32 that covers the internal conductive member 31, the external conductive member 33 that covers further the insulating member 32 and the mountain-shaped conductive member 34 that connects to the external conductive member 33 at the upper edge thereof. Thus, it is possible to allow the horizontal plane directional characteristic in a vertically polarized wave of the sleeve antenna 30 to approach the ideal omnidirectional characteristic, thereby making it possible to obtain the required gain. This enables the antenna apparatus 1 to be preferably made use of as an information communication antenna for a vehicle onboard application or the like. In particular, an average gain would be increased by setting the angle $\alpha$ formed by the line connecting the upper edge and the lower edge of the mountain-shaped conductive member 34 and the axial direction of the external conductive member 33 in the range from about 10° to about 30°.

(2) The antenna apparatus 1 includes the board 7 on which the receptacle 41 of the coaxial connector 40 is provided and the sleeve antenna 30 that is provided on the plug 45 of the axial connector 40, and the sleeve antenna 30 is erected perpendicularly with respect to the board 7 with coupling the plug 45 to the receptacle 41. This makes it easier to fabricate the antenna apparatus 1 than a case where the sleeve antenna 30 is erected vertically by soldering the sleeve antenna 30 to the board 7. Namely, in the case of a conventional soldering process, there may be a case where the sleeve antenna is not erected perfectly perpendicular with respect to the board to thereby be inclined. Then, when attempting to deal properly with the inclined sleeve antenna, it will take more labor hours. The sleeve antenna 30 can be erected perpendicular with respect to the board 7 in an ensured fashion by using the coaxial connector 40 in mounting the sleeve antenna 30 on the board 7. This makes it difficult to generate a deviation in directional characteristic and enables the directional characteristic of the sleeve antenna 30 to approach the ideal omnidirectional characteristic.

(3) With the sleeve antenna 30 having the mountain-shaped conductive member 34, even though a planar antenna lies near thereto, the directional characteristic has a little deterioration, and the horizontal plane directional characteristic becomes better than that of the monopole antenna. Further, with the sleeve antenna 30, the horizontal plane directional characteristic would be obtained that is as good as that of the vertical dipole antenna, and its vertical height would be made lower than that of the vertical dipole antenna. This would provide the antenna apparatus that is suitable for miniaturization.

(4) With the sleeve antenna 30, even though the vertical height from the metallic base 5 functioning as a reference plane is equal to or less than 70 mm, a sufficient average gain would be obtained, and hence, the sleeve antenna 30 would be applied to a shark fin-type antenna apparatus.

Figure 16:
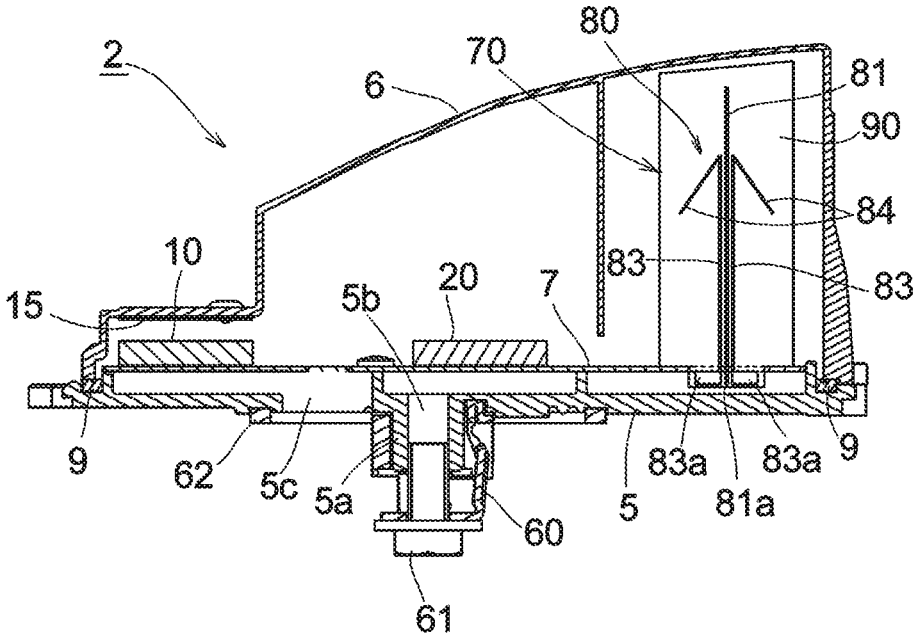
FIG. 16 is a side sectional view showing a longitudinal section of an antenna apparatus of a second exemplary embodiment.
Figure 17:
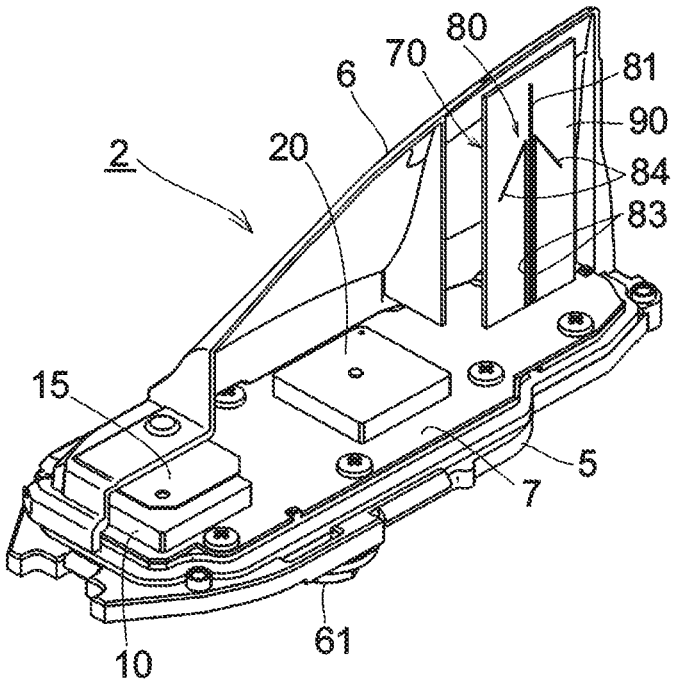
FIG. 17 is a perspective view of the second exemplary embodiment with an inner case sectioned half longitudinally.
Figure 18:
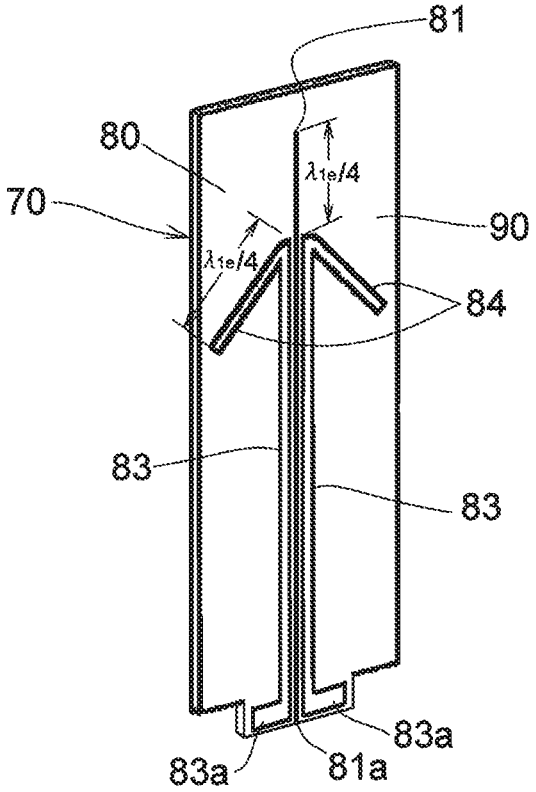
FIG. 18 is a perspective view showing a main face of a V2X antenna board of the second exemplary embodiment.

Referring to FIGS. 16 to 18, an antenna apparatus according to a second exemplary embodiment will be described. An antenna apparatus 2 of the second exemplary embodiment utilizes an antenna board 70 on which a V2X sleeve antenna 80 is provided in place of the sleeve antenna 30 of the first exemplary embodiment that has been described above. The antenna board 70 is erected substantially perpendicularly with respect to a board 7 and is fixed thereto. The antenna board 70 includes the sleeve antenna 80 that is provided on a main face (one face) of an insulating board 90. The sleeve antenna 80 includes a linear internal conductive pattern 81, linear external conductive patterns 83 that are provided parallel to each other on both sides of the internal conductive pattern 81, and mountain-shaped conductive patterns 84 that connect to upper ends of the corresponding external conductive patterns 83. The mountain-shaped conductive patterns 84 are provided on outer sides of the external conductive patterns 83 that hold the internal conductive pattern 81 therebetween. Specifically, the mountain-shaped conductive patterns 84 are linear patterns that are disposed axisymmetrical with respect to the internal conductive pattern 81 and are inclined downwards to form an acute angle with respect to axial directions of the corresponding external conductive patterns 83. The internal conductive pattern 81, the external conductive patterns 83 and the mountain-shaped conductive patterns 84 are formed, for example, by printing corresponding conductive patterns on the insulating plate 90 or etching a conductive foil that is affixed to the insulating plate 90 into corresponding patterns. The internal conductive pattern 81 and the external conductive patterns 83 are disposed apart from each other with a predetermined interval held therebetween on the main face of the insulating member 90. The mountain-shaped conductive patterns 84 make up a two-dimensional conductive pattern that corresponds to a sectional shape resulting from cutting the mountain-shaped conductive member 34 of the first exemplary embodiment along a plane that passes through the internal conductive member 31. The internal conductive pattern 81 protrudes upwards so as to be higher than the external conductive patterns 83 above upper edges (upper ends) of the mountain-shaped conductive patterns 84. No conductive pattern or the like is formed on an opposite side to the main face of the insulating plate 90 (nothing is provided).

Assuming that an effective wavelength of an operation frequency of the sleeve antenna 80 on the insulating plate 90 is $\lambda_{1e}$, a length from an upper end to a lower end of each of the mountain-shaped conductive patterns 84 is $\lambda_{1e}/4$, and a vertical length of the internal conductive pattern 81 above the upper ends of the mountain-shaped conductive patterns 84 is also $\lambda_{1e}/4$. A feed point of the sleeve antenna 80 is at a lower end portion of the antenna board 70 that is inserted into the board 7. A lower end portion 81*a* of the internal conductive pattern 81 connects to a central conductive member of a coaxial cable, not shown in the drawings, and lower end portions 83*a* of the external conductive patterns 83 connected to an external conductive member of the coaxial cable. The other configurations of the antenna apparatus 2 are similar to those of the antenna apparatus 1 of the first exemplary embodiment.

Figure 20:
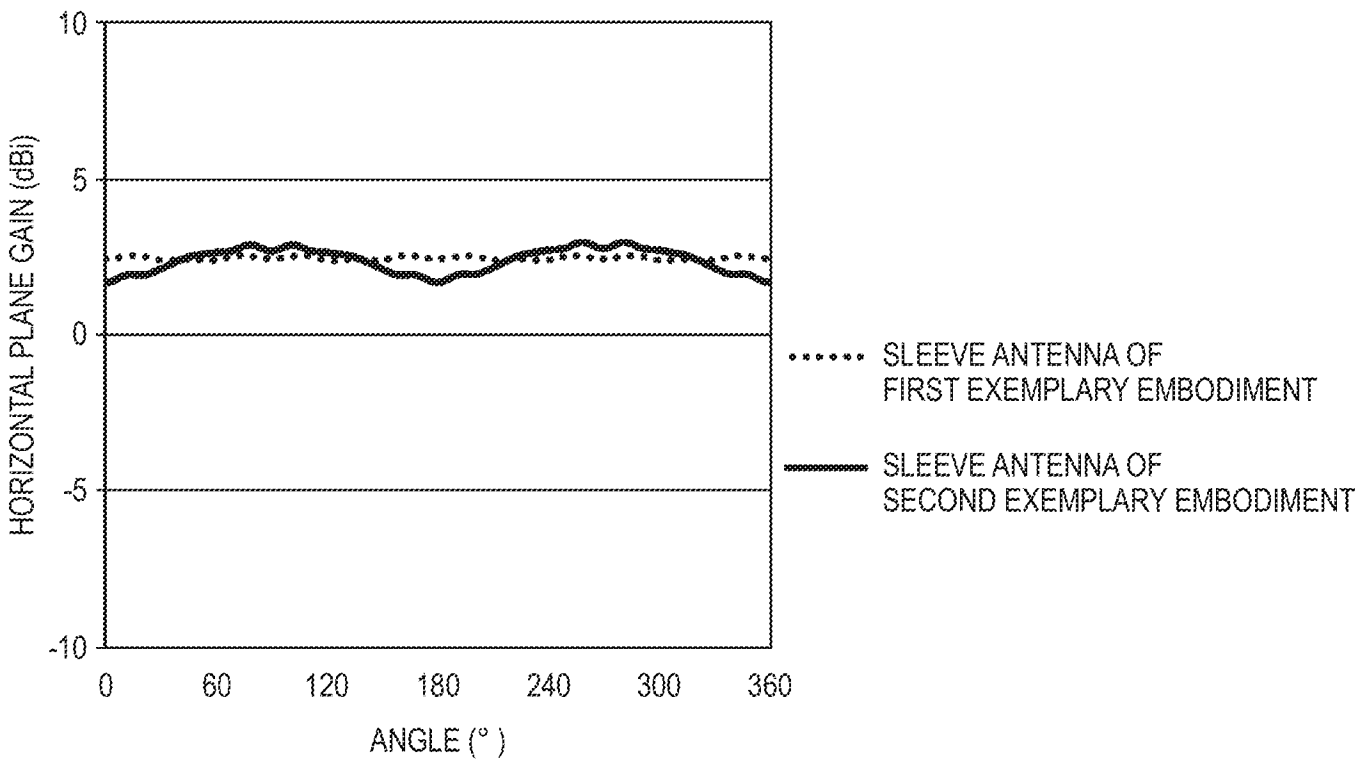
FIG. 20 is a simulated directional characteristic diagram showing a comparison of a horizontal plane directivity of the V2X sleeve antenna of the second exemplary embodiment that erects substantially perpendicularly with respect to the antenna board with a horizontal plane directivity of the V2X sleeve antenna of the first exemplary embodiment.

FIG. 20 is a simulated directional characteristic diagram showing a horizontal plane directional characteristic of the V2X sleeve antenna 80 that erects substantially perpendicular with respect to the board 7 of the second exemplary embodiment in comparison with the V2X sleeve antenna 30 of the first exemplary embodiment. Although the V2X sleeve antenna 80 of the second exemplary embodiment utilizes the planar (two-dimensional) mountain-shaped conductive patterns 84, a directional characteristic close to that of the sleeve antenna 30 of the first exemplary embodiment is obtained.

Since the antenna apparatus 2 of the second exemplary embodiment utilizes the antenna board 70 in which the sleeve antenna 80 is formed on the one face of the insulating plate 90, the antenna apparatus 2 would be formed more inexpensively than the sleeve antenna 30 of the first exemplary embodiment that has the three-dimensional mountain-shaped conductive member 34. In addition, since the sleeve antenna 80 is simpler in structure than the sleeve antenna 30, the quality of produced sleeve antennas varies less, which increases the productivity thereof.

Figure 19:
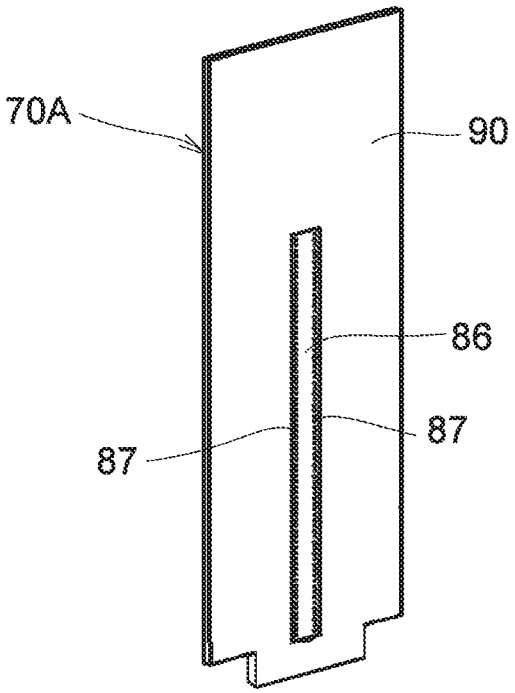
FIG. 19 is a perspective view showing an opposite side to the main face of a V2X antenna board of a third exemplary embodiment.

FIG. 19 shows an opposite side of a main face of an antenna board 70A that is possessed by a V2X sleeve antenna of an antenna apparatus 3 of a third exemplary embodiment. In this case, the main face of the antenna board 70A is the same as that of the antenna board 70 shown in FIG. 18. A rear external conductive pattern 86 is provided on an opposite side to a main face of an insulating plate 90. The rear external conductive pattern 86 connects to outer external conductive patterns 83 (FIG. 18) provided on the main face via a number of through holes 87. The other configurations than the opposite side to the main face of the antenna board 70A are similar to those of the second exemplary embodiment.

Figure 21:
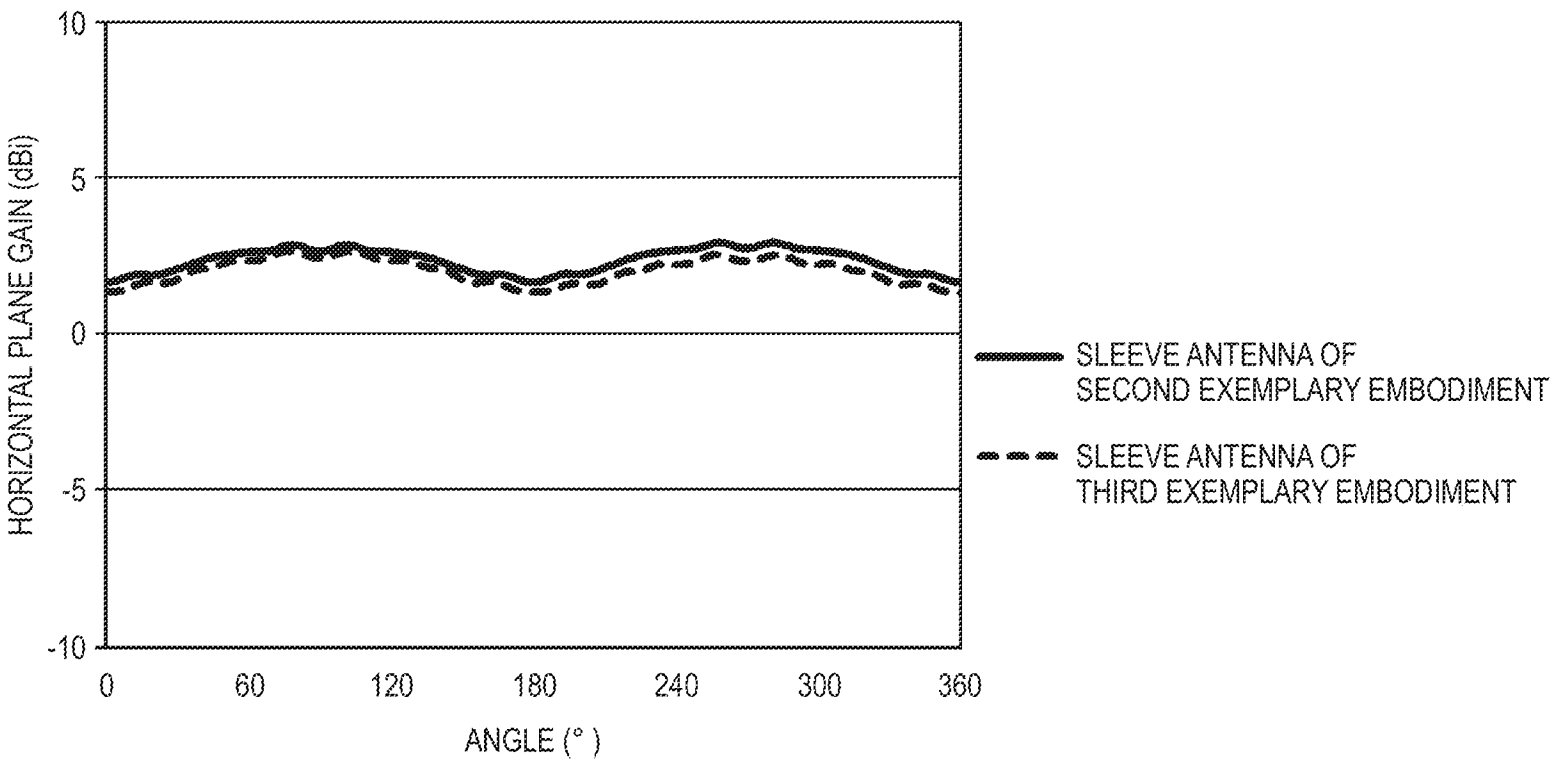
FIG. 21 is a simulated directional characteristic diagram showing a comparison of the horizontal plane directivity of the V2X sleeve antenna of the second exemplary embodiment that erects substantially perpendicularly with respect to the antenna board with a horizontal plane directivity of the V2X sleeve antenna of the third exemplary embodiment that erects substantially perpendicularly with respect to an antenna board thereof.

FIG. 21 is a simulated directional characteristic diagram showing a horizontal plane directional characteristic of the V2X sleeve antenna (with the rear external conductive pattern 86) that is substantially perpendicular to a board 7 of the third exemplary embodiment in comparison with the sleeve antenna 80 for V2X that is substantially perpendicular with respect to the board 7 of the second exemplary embodiment. A gain in the second exemplary embodiment is slightly superior to the gain in the third exemplary embodiment in all directions. This is because in the case of the second exemplary embodiment, the internal conductive pattern 81 between the external conductive patterns 83 can contribute to radiation of radio waves.

It is understood by those skilled in the art to which the invention pertains that the constituent elements and the working processes that are described in the embodiments may be modified variously. Hereinafter, modified examples will be described.

In the embodiments, the height of the inner case is set low on the front side and high on the rear side on the premise that the antenna apparatus is mounted on a vehicle and more particularly on a roof of the vehicle. However, arbitrary case structures are adopted according to applications.

In the first exemplary embodiment, a structure may be adopted in which the coaxial cable is connected directly to a rear face of the board of the coaxial connector where the sleeve antenna is mounted so that the coaxial cable is pulled out of the bottom face of the base.

Although the antenna boards 70, 70A that are used in the second and third exemplary embodiments are provided so as to follow the longitudinal direction of the antenna apparatus 2 as shown in FIGS. 16 and 17, the antenna boards 70, 70A may be provided so as to follow a left-and-right or transverse direction of the antenna apparatus 2.

Although the planar antenna is exemplified as another antenna that is accommodated within the case together with the sleeve antenna, a different type of antenna may be so accommodated.

In the exemplary embodiments, a telephone antenna that is formed of a plate of a metallic sheet may be provided between the V2X sleeve antennas 30, 80 and the GPS planar antenna 20.

DESCRIPTION OF REFERENCE NUMERALS

1 antenna apparatus; 5 base; 6 inner case; 7 board; 10, 20 planar antenna; 30, 80 sleeve antenna; 31 internal conductive member; 32 insulating member; 33 external conductive member; 34 mountain-shaped conductive member; 40 coaxial connector; 41 receptacle; 45 plug; 70, 70A antenna board; 81 internal conductive pattern; 83 external conductive pattern; 84 mountain-shaped conductive pattern; 90 insulating plate.

What is claimed is:

1. An antenna apparatus comprising:
a circuit board;
a sleeve antenna; and
a coaxial connector including a pair of coupling members,
wherein one of the coupling members of the coaxial connector is fixed on the circuit board,
wherein the sleeve antenna is fixed on another one of the coupling members of the coaxial connector,
wherein the sleeve antenna erects with respect to the circuit board by coupling the another one of the coupling members to the one of the coupling members,
wherein the sleeve antenna includes a mountain-shaped conductive member having an upper edge and a lower edge, and
wherein the mountain-shaped conductive member radially expands from the upper edge towards the lower edge of the mountain-shaped conductive member.

2. The antenna apparatus according to claim 1, wherein the sleeve antenna includes:
an internal conductive member electrically connected to a central conductive member of the another one of the coupling members;
an insulating member covering the internal conductive member; and
an external conductive member covering the insulating member and electrically connected to an outer circumferential conductive member of the another one of the coupling members,
wherein the mountain-shaped conductor electrically connected to the external conductive member, and
wherein the internal conductive member protrudes upward from the upper edge of the mountain-shaped conductive member.

3. The antenna apparatus according to claim 2, wherein a line connecting the upper edge and the lower edge of the mountain-shaped conductive member is inclined in an acute angle with respect to an axial direction of the external conductive member.

4. The antenna apparatus according to claim 2, further comprising:
a base;
a case; and
a different type of antenna from the sleeve antenna,
wherein the sleeve antenna and said different type of antenna are disposed in an internal space surrounded by the base and the case.

5. The antenna apparatus according to claim 4,
wherein the different type of antenna is a planar antenna,
wherein the planar antenna is disposed so that a direction of its directivity is upward of the base,
wherein the sleeve antenna is disposed so as to erect with respect to the base,
wherein a distance D between centers of the sleeve antenna and the planar antenna is $D \leq \lambda_1 + \lambda_2/4$
wherein the $\lambda_2$ is a wavelength of an operation frequency of the sleeve antenna, and
wherein the $\lambda_2$ is a wavelength of an operation frequency of the planar antenna.

6. The antenna apparatus according to claim 4, wherein a distance between the base and a top of the sleeve antenna is equal to or less than 70 mm.

7. The antenna apparatus according to claim 1,
wherein a central conductive member of the coaxial connector is electrically connected to an internal conductive member of the sleeve antenna, and
wherein an outer circumferential conductive member of the coaxial connecter is electrically connected to an external conductive member of the sleeve antenna.

8. The antenna apparatus according to claim 1,
wherein the another one of the coupling members is fixed in the one of the coupling members.

9. The antenna apparatus according to claim 1,
wherein the coaxial connector includes a coaxial structure such that a central conductive member of the one of the coupling members is connected to a corresponding conductive member of the another one of the coupling members and an outer circumferential conductive member of the one of the coupling members is connected to a corresponding outer circumferential conductive member of the another one of the coupling members.

10. An antenna apparatus, comprising:
a circuit board;
a sleeve antenna; and
a coaxial connector including a coupling member,
wherein one side of the coupling member is fixed on the circuit board,
wherein the sleeve antenna is fixed on another side of the coupling member,
wherein the sleeve antenna erects with respect to the circuit board by the coupling member,
wherein the sleeve antenna includes a mountain-shaped conductor having an upper edge and a lower edge, and
wherein the mountain-shaped conductive member radially expands from the upper edge towards the lower edge of the mountain-shaped conductive member.

11. The antenna apparatus according to claim 10, wherein the sleeve antenna includes:
an internal conductive member electrically connected to a central conductive member of the another side of the coupling member;
an insulating member covering the internal conductive member; and
an external conductive member covering the insulating member and electrically connected to an outer circumferential conductive member of the another side of the coupling member,
wherein the mountain-shaped conductor is electrically connected to the external conductive member, and
wherein the internal conductive member protrudes upward from the upper edge of the mountain-shaped conductive member.

12. The antenna apparatus according to claim 10, wherein the coupling member is composed of a first member and a second member, and the first member is coupled to the second member.

* * * * *